US011326292B2

(12) United States Patent
Kwon et al.

(10) Patent No.: US 11,326,292 B2
(45) Date of Patent: May 10, 2022

(54) DRUM WASHING MACHINE AND METHOD FOR CLEANING TUB THEREOF

(71) Applicant: LG ELECTRONICS INC., Seoul (KR)

(72) Inventors: Sunku Kwon, Seoul (KR); Youngho Kim, Seoul (KR); Kahyung Choi, Seoul (KR); Hocheol Kwon, Seoul (KR); Youngkee Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 638 days.

(21) Appl. No.: 16/073,837

(22) PCT Filed: Jan. 20, 2017

(86) PCT No.: PCT/KR2017/000704
§ 371 (c)(1),
(2) Date: Jul. 30, 2018

(87) PCT Pub. No.: WO2017/135602
PCT Pub. Date: Aug. 10, 2017

(65) Prior Publication Data

US 2019/0032267 A1 Jan. 31, 2019

(30) Foreign Application Priority Data

Feb. 1, 2016 (KR) ..... 10-2016-0012220
Feb. 1, 2016 (KR) ..... 10-2016-0012224

(51) Int. Cl.

| | |
|---|---|
| ***D06F 37/36*** | (2006.01) |
| ***D06F 23/02*** | (2006.01) |
| ***D06F 39/08*** | (2006.01) |
| ***D06F 37/20*** | (2006.01) |

(Continued)

(52) U.S. Cl.
CPC ..... *D06F 33/43* (2020.02); *D06F 23/02* (2013.01); *D06F 37/04* (2013.01); *D06F 37/36* (2013.01);
(Continued)

(58) Field of Classification Search
CPC ..... D06F 23/02; D06F 37/04; D06F 37/40; D06F 37/36; D06F 33/43; D06F 21/00;
(Continued)

(56) References Cited

U.S. PATENT DOCUMENTS 7,530,132 B2 5/2009 Kim
7,797,778 B2 9/2010 Lee
(Continued)

FOREIGN PATENT DOCUMENTS

CN 101305122 11/2008
CN 103459701 12/2013
(Continued)

OTHER PUBLICATIONS

PCT-ISR dated May 22, 2017.
(Continued)

*Primary Examiner* — Benjamin L Osterhout
(74) *Attorney, Agent, or Firm* — Birch, Stewart, Kolasch & Birch, LLP

(57) ABSTRACT

A drum washing machine includes a tub and a drum rotatably supported in the tub and implements a control method that allows the tub to be easily cleaned. The method of controlling the washing machine includes supplying washing water during a first water supplying step to the interior of the tub while the drum is rotating at a water-supplying RPM; and executing a first wash step following completion of the first water supply step by accelerating the rotation of the drum from the water-supplying RPM to a first-wash RPM so that a circulatory flow is created in which the
(Continued)

washing water falls from the top of opposite ends of the tub while circulating along the inner circumferential surface of the tub due to the rotational power of the drum.

20 Claims, 5 Drawing Sheets

(51) Int. Cl.

| | |
|---|---|
| ***D06F 35/00*** | (2006.01) |
| ***D06F 33/43*** | (2020.01) |
| ***D06F 37/40*** | (2006.01) |
| ***D06F 37/04*** | (2006.01) |
| *D06F 21/00* | (2006.01) |
| *D06F 103/26* | (2020.01) |
| *D06F 105/02* | (2020.01) |
| *D06F 105/08* | (2020.01) |

(52) U.S. Cl.
CPC ..... *D06F 37/40* (2013.01); *D06F 21/00* (2013.01); *D06F 39/085* (2013.01); *D06F 2103/26* (2020.02); *D06F 2105/02* (2020.02); *D06F 2105/08* (2020.02)

(58) Field of Classification Search
CPC ..... D06F 2105/02; D06F 2103/26; D06F 2105/08; D06F 39/085
See application file for complete search history.

(56) References Cited

U.S. PATENT DOCUMENTS

| | | | | |
|---|---|---|---|---|
| 8,370,980 | B2 * | 2/2013 | Minayoshi ..... | D06F 35/006 8/158 |
| 2011/0146004 | A1 | 6/2011 | Kim et al. | |

FOREIGN PATENT DOCUMENTS

| | | | |
|---|---|---|---|
| CN | 103547725 | | 1/2014 |
| CN | 104032539 | | 9/2014 |
| CN | 104911864 | | 9/2015 |
| EP | 2725129 | A1 * | 4/2014 |
| JP | H05184778 | A | 7/1993 |
| JP | H08299679 | A | 11/1996 |
| JP | 2004016399 | A | 1/2004 |
| JP | 2013-075172 | | 4/2013 |
| JP | 2014140777 | | 8/2014 |
| JP | WO2015021722 | | 2/2015 |
| KR | 10-2006-0009084 | | 1/2006 |
| KR | 10-2007-0057568 | | 6/2007 |
| KR | 10-0739611 | | 6/2007 |
| KR | 100739610 | | 7/2007 |
| KR | 10-2008-0088274 | | 10/2008 |
| KR | 10-2010-0110509 | | 10/2010 |
| KR | 20110031764 | | 3/2011 |
| KR | 20160004253 | | 1/2016 |
| WO | WO2007/055475 | A1 * | 5/2007 |
| WO | WO 2008/004801 | | 1/2008 |

OTHER PUBLICATIONS

E-ISR dated May 22, 2017.
Written Opinion of the International Searching Authority dated May 22, 2017.
European Search Report dated Oct. 23, 2019.

* cited by examiner

【FIG 1】
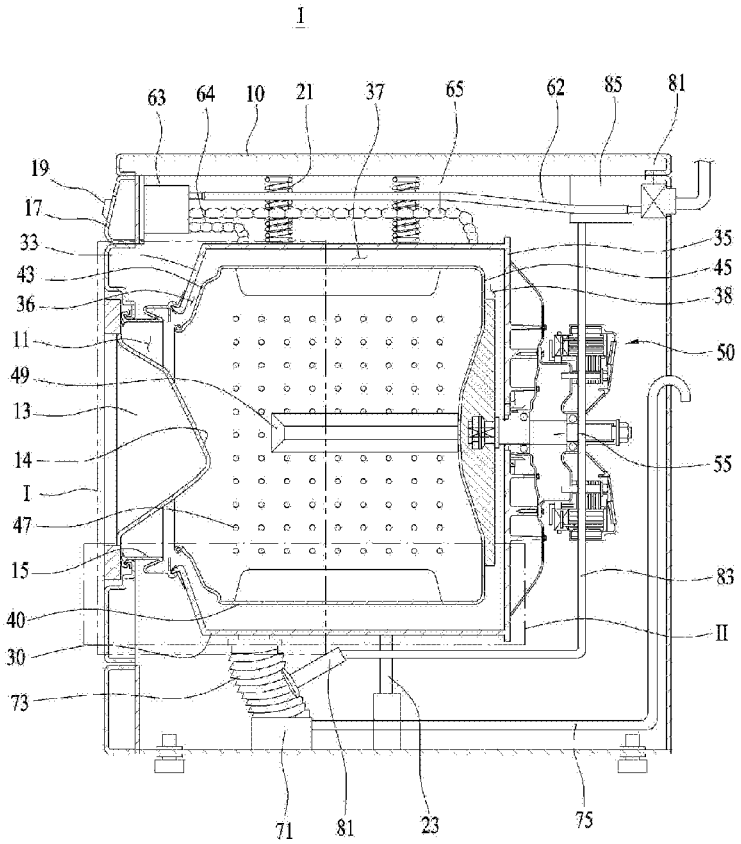

【FIG 2】
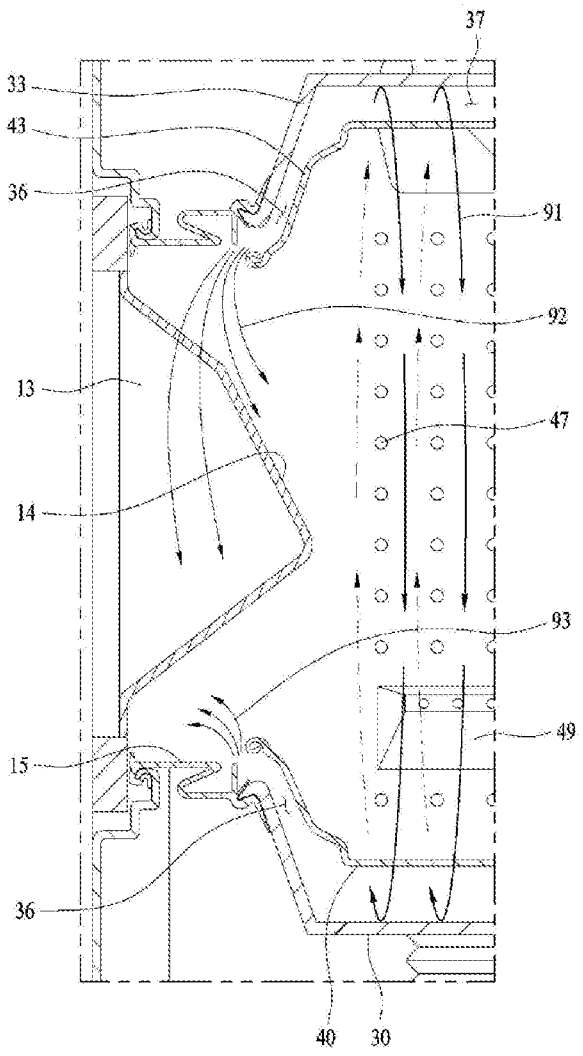

【FIG 3】
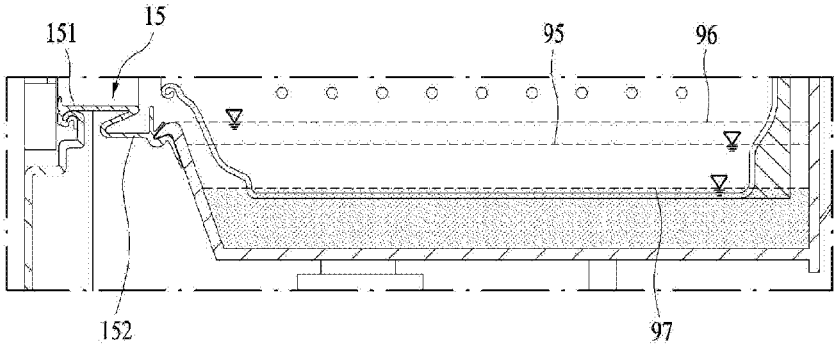
【FIG 4】
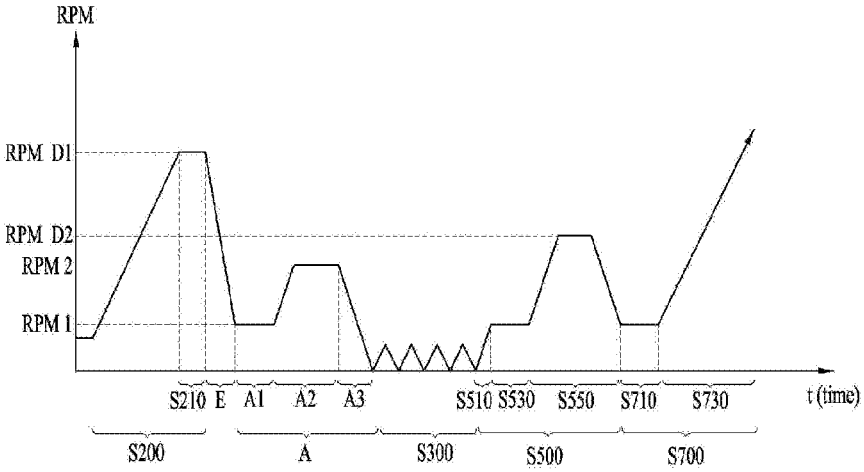

【FIG 5】
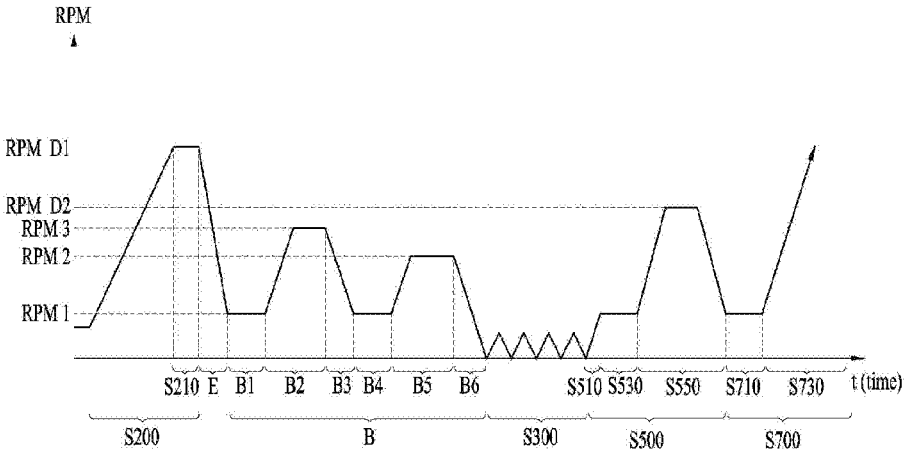
【FIG 6】
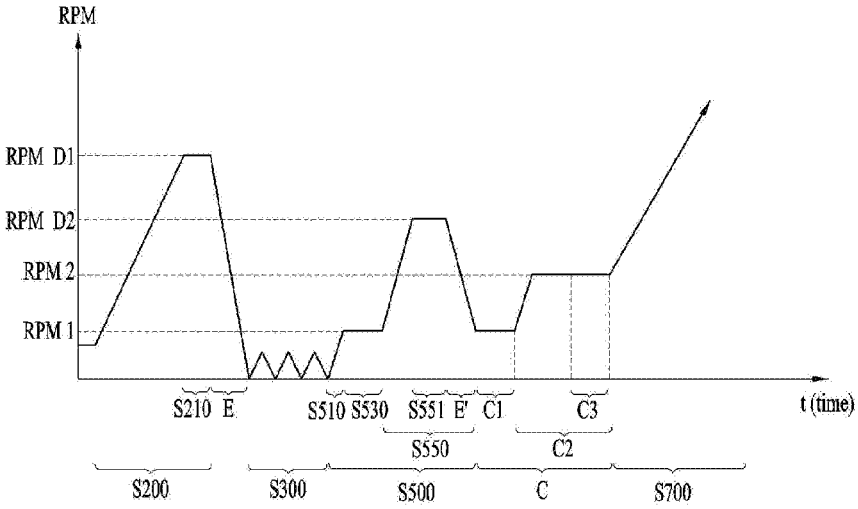

【FIG 7】
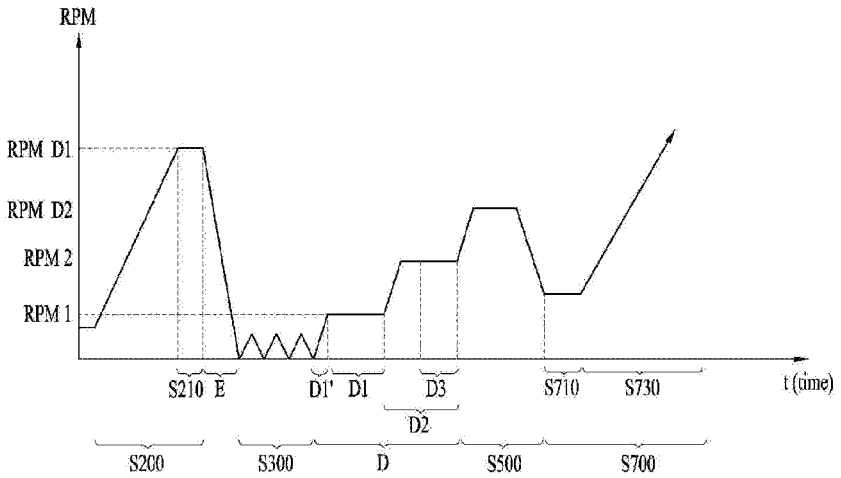

DRUM WASHING MACHINE AND METHOD FOR CLEANING TUB THEREOF

CLAIM FOR PRIORITY

This application is a U.S. National Phase entry under 35 U.S.C. § 371 from PCT International Application No. PCT/KR2017/000704, filed Jan. 20, 2017, which claims the benefit of priority of Korean Patent Applications Nos. 10-2016-0012220, 10-2016-0012222, 10-2016-0012224, and 10-2016-0012219, all filed Feb. 1, 2016, and all of which are incorporated herein by reference in their entireties.

FIELD

Embodiments of the present disclosure relate to a washing machine, more specifically, a drum washing machine allowing a tub to be easily washed and cleaned, and a method for cleaning the tub of the drum washing machine.

BACKGROUND

Generally, a drum washing machine is an electric appliance configured to wash laundry, using a friction force between a drum rotated by a driving force of a motor and the laundry loaded therein together with detergent and wash water which are mixedly supplied to the drum and a drop impact of the laundry. The drum washing machine is capable of generating little wrinkles and entanglement in the laundry and has a washing effect of hand-scrubbing.

A pulsator type washing machine includes an outer tub for holding wash water and an inner tub (or spinning tub) provided in the outer tub. In a state where laundry is submerged in the wash water supplied to the inner tub, washing is performed and a large amount of wash water is consumed in the pulsator type washing machine. The washing of such the pulsator type washing machine is performed, using the friction force between the wash water and the laundry and chemical action of detergent which are facilitated by the rotation of the inner tub or the pulsator provided in a lower area of the inner tub to form water currents. In other words, the pulsator type washing machine includes a shaft of the inner tub which is oriented substantially perpendicular to the ground such that the washing can be performed only when wash water is supplied enough to submerge the laundry in the wash water.

However, the drum washing machine includes a drum and a shaft of the drum is substantially oriented horizontal with respect to the ground such that the laundry can fall to be washed only when a small amount of wash water is supplied to the drum. The drum of the drum washing machine is partially submerged in the wash water and such submerging is repeated whenever the washing machine is driven.

In this instance, the tub is not driven, and the wash water can be dispersed to all areas of the inner tub while the inner tub is rotating at a high speed. Accordingly, contaminants or water dirt or slime might accumulate on the inner circumferential surface area of the tub. As time passes, such contaminants or slime might spoil and give out a bad smell or contaminate the laundry. Especially, an inner surface of a door or an upper area of the inner circumferential surface of the tub will not be submerged in the wash water. Once such contaminants or slime accumulate, some area might become dry and it is not easy to remove the contaminants or slime disadvantageously.

Moreover, various suggestions are made so as to wash and clean the inner circumferential surface of the tub. However, it is not easy to clean the tub and the drum without using an auxiliary device. While the drum is rotated at a high speed, the friction force between the wash water and an outer circumferential surface of the drum will generate a sever load on a motor. Even if the drum is rotated at a very high speed, it is difficult for the wash water to reach the uppermost area of the inner circumferential surface of the tub.

Also, the drum of the drum washing machine is rotated at a high speed while wash water is supplied to the drum having the laundry unloaded therefrom such that the supplied wash water cannot be used in the following steps, but must be drained, only to cause a disadvantage of water waste.

When the drum holding the laundry is rotated at a high speed, the laundry loaded in the drum might generate severe vibration disadvantageously.

The detergent used in cleaning the tub has a strong detergency, different conventional detergent for washing. To have the strong detergency, the detergent for cleaning the tub usually has many chemical components which might cause water pollution and has a problem of non-eco-friendly.

DETAILED DESCRIPTION OF THE INVENTION

Technical Problem

To overcome the disadvantages, an object of the present invention is to address the above-noted and other problems and to provide a drum washing machine which may easily wash and clean a tub, using the wash water circulated along an inner circumferential surface of the tub.

Technical Solution

To achieve these objects and other advantages and in accordance with the purpose of the embodiments, as embodied and broadly described herein, embodiments of the present disclosure also provide a control method of a washing machine comprising a wash cycle and a rinse cycle. The control method comprises a first water supply step for supplying wash water to a tub while a drum is rotated at a water supply RPM; and a first washing step which starts after the first water supply step is complete, the first washing step including accelerating the rotating drum from the water supply RPM to a first washing RPM for the wash water to form a circulating water current falling from an upper area of opposite ends of the tub while being circulated along an inner circumferential surface of the tub by the rotational force of the drum.

The control method of the washing machine may further comprise a spinning step which is performed during the wash cycle for removing moisture from the laundry loaded in the drum by accelerating the drum. The first water supply step may include continuously rotating the drum, which is decelerated to the water supply RPM when the spinning step ends.

The water supply RPM may be the minimum RPM that will prevent the laundry rotated along the rotating drum from becoming separated from an inner circumferential surface of the drum as a result of a generated centrifugal force.

The water supply step may supply the wash water to the tub to a preset water level and switch off a drainage pump.

The preset water level of the first water supply step may be a water level at which a user is able to check the supplied wash water during the first washing step from outside the washing machine.

The preset water level of the first water supply step may be the same height or more as the distance from a lower end of the tub to a lower end of the drum.

The drainage pump may be switched off in the first washing step.

An eccentricity value of the drum may be sensed in at least one of the first water supply step and the first washing step.

When the sensed eccentricity value is over a reference eccentricity value, the wash water remaining in the drum may be drained and the first water supply step may then re-start.

When the sensed eccentricity value is over a reference eccentricity value, the rinse cycle may start in a state where the drainage pump is switched off to keep the wash water remaining in the tub.

The control method of the washing machine may further comprise a second water supply step which is performed once the first washing step is complete, the second water supply step including allowing additional water supply into the tub while the drum is rotated at the water supply RPM; and a second washing step, which is performed once the second water supply step is complete, the second washing step including accelerating and rotating the drum at a second washing RPM higher than the water supply RPM and lower than the first washing RPM for the wash water, which includes an additional water supply to form the circulating water current.

The second water supply step may continuously rotate the drum, which is decelerated to the water supply RPM when the first washing step ends, with the drum rotating at the water supply RPM.

The control method of the washing machine may further comprise a spinning step which is performed during the wash cycle. The spinning step removes moisture from laundry loaded in the drum by accelerating the drum to a spinning RPM. A braking step is performed after the spinning step, with the braking step including applying a preset amount of braking force to the rotating drum by colliding the supplied wash water with an outer circumferential surface of the rotating drum such that the wash water collided with the drum also strikes and washes at least one point of the tub inner circumferential surface.

The spinning step may include supplying wash water toward the outer circumferential surface of the rotating drum.

The spinning step may comprise rotating the drum while maintaining the spinning RPM, and supplying wash water toward the outer circumferential surface of the rotating drum.

The braking step may include switching off the drainage pump.

In the braking step, the wash water may be supplied via a plurality of wash water supply units provided to strike a plurality of points of the tub inner circumferential surface.

The plurality of the wash water supply units may be spaced a preset distance apart from each other along a longitudinal direction of the tub.

The first water supply step may be performed after the braking step and while continuously rotating the drum. The drum may be decelerated to the water supply RPM in the braking step.

The control method of the washing machine may further comprise a tub washing course for circulating the wash water along the inner circumferential surface of the tub; and a course recognizing step for recognizing at least one of a plurality of washing courses including the tub washing course, wherein when one of the washing courses is recognized, the first water supply step and the first washing step start right before the last step of the rinse cycle, and when only the tub washing course is recognized, only the first water supply step and the first washing step start.

Advantageous Effects

As described above, the washing machine according to the embodiments of the present disclosure has following advantageous effects.

The drum washing machine is capable of washing off contaminant or slime that accumulates anywhere on the entire inner circumferential surface of the tub or the entire outer circumferential surface of the drum.

The drum washing machine is also capable of easily washing and cleaning the tub even without an auxiliary device for washing the tub.

A special detergent for washing the tub is not needed. The tub of the drum washing machine can be washed by using even a small amount of detergent. Accordingly, an eco-friendly tub washing method may be provided.

The door inner surface and the gasket may be washed simultaneously while the tub inner circumferential surface and the drum outer circumferential surface are washed.

When a dry-spinning cycle starts after washing the tub inner circumferential surface and the drum outer circumferential surface, any vibration generated during the dry-spinning cycle may be reduced during the washing course without any auxiliary devices.

BRIEF DESCRIPTION OF THE DRAWINGS

FIG. 1 is a sectional diagram schematically illustrating a structure of a drum washing machine in accordance with one embodiment of the present disclosure;

FIG. 2 is an enlarged view of section 'I' shown in FIG. 1 to describe wash water flow;

FIG. 3 is an enlarged view of section 'II' shown in FIG. 1 to describe a water level of wash water;

FIG. 4 is a graph illustrating a tub washing method in accordance with one embodiment;

FIG. 5 is a graph illustrating a tub washing method in accordance with another embodiment;

FIG. 6 is a graph illustrating a tub washing method in accordance with a further embodiment; and FIG. 7 is a graph illustrating a tub washing method in accordance with yet another embodiment.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

It will be understood that although the terms first, second, etc. may be used herein to describe various elements, these elements should not be limited by these terms. These terms are generally only used to distinguish one element from another.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

FIG. 1 is a sectional diagram schematically illustrating a structure of a drum washing machine 1 in accordance with one embodiment of the present disclosure.

Referring to FIG. 1, the drum washing machine in accordance with one embodiment incudes a cabinet 10 having a laundry introduction opening 11 formed in a front surface; a door 11 coupled to the laundry introduction opening of the cabinet 1; a tub mounted in the cabinet to hold wash water; a motor mounted in the tub 30 and configured to generate a driving force; a shaft 55 connected to the motor 50; a drum 40 connected with the shaft 55 and configured to wash the laundry by using the driving force transmitted from the motor 50; and a controller 17. The controller 17 may be configured to control a water level in the tub, and the rotation speed (or torque) of the motor to cause the wash water supplied to the tub 30 to wash the door 11 and a gasket 15 around the door as well as an inner circumferential surface of the tub 30, while the wash water is circulated along the inner circumferential surface of the tub 30 by the rotational force of the drum 40.

In the embodiments of the present disclosure, the wash water refers to both the wash water for washing the laundry and the wash water for washing the gasket 15, the door 11, the tub 30 and the drum.

The motor 50 shown in FIG. 1 is shown as a direct-drive motor configured to drive the drum 40, but the embodiments are not limited thereto. Also, the controller 17 shown in FIG. 1 is provided in a control panel provided in the front surface of the cabinet 10, but the embodiments are not limited thereto.

The cabinet 10 may define the exterior appearance of the drum washing machine 1 and the laundry introduction opening 11 may be formed in the front surface of the cabinet 10 to facilitate the communication between the inside and outside of the dry type washing machine. The door 11 is rotatably coupled to the front surface to selectively open and close the laundry introduction opening 11. Accordingly, a user is able to load or unload the laundry into or from the inside of the drum.

In this instance, the door 11 has an inner surface directed and projected toward the drum 40. When the user pushes and closes the door 11, a predetermined area of the door inner surface becomes located in the drum 40 such that the laundry can be washed only in the drum 40 and the laundry does not escape out of the drum 40 during the rotation of the drum 40.

The tub 30 is mounted in the cabinet 10 and configured to accommodate wash water. The tub 30 is supplied wash water from an external water supply source. Also, the tub is formed in an approximately cylindrical shape, with a circumferential surface and opposite ends. A front one of the opposite ends forms a front surface 33 of the tub and a rear one of the opposite ends forms a rear surface 35 of the tub. A front opening is formed in the front surface 33 of the tub 30 to facilitate the communication between the inside and outside of the drum 40, corresponding to the laundry introduction opening 11 of the cabinet 10.

The circumferential surface of the tub 30 is flexibly supported by a spring 21 and a damper 23 which are installed in the cabinet 10. As the circumferential surface is directly supported by the spring 21 and the damper 23, the tub 30 is not rotatable. Accordingly, the tub 30 may not be provided with an auxiliary rotational force from the motor 50, different from the drum 40.

A water supply mechanism is connected to an upper area of the tub 30 to supply the water containing detergent or the clean water containing no detergent.

The water supply mechanism may include a water supply valve 61 configured to intermittently control the clean water supplied via an external hose; a water supply hose 62 configured to guide the water downstream of the water supply valve 61; a detergent supply unit 62 configured to exhaust the water supplied via the water supply hose 62, mixed together with the detergent stored therein; and a water supply pipe configured to guide the water containing the detergent or the clean water containing no detergent which is exhausted from the detergent supply unit 63, having one end connected to an outlet of the detergent supply unit 62 and the other end connected to the upper area of the tub 30.

In this instance, the water supply pipe may include one pipe or a first water supply pipe 64 and a second water supply pipe 65 as shown in FIG. 1.

The first water supply pipe 64 and the second water supply pipe 65 are spaced a preset distance apart in a longitudinal direction, especially in an area of the inner circumferential surface of the tub or an outer circumferential surface of the drum 40, corresponding to the polluted area having contaminants or slime which needs washing. Alternatively, the first water supply pipe 64 and the second water supply pipe 65 may be configured as bellows hoses to avoid transmitting the vibration of the tub 30 to the detergent supply unit 63.

The water supply hose disclosed in this embodiment includes a single water supply hose or the first water supply pipe 64 and the second water supply pipe 65, but the embodiments of the present disclosure are not limited thereto. Alternatively, a predetermined number of water supply pipes may be additionally arranged according to a pattern of contamination accumulated in the tub 30 or the drum 40.

In addition, a drainage mechanism configured to drain the water is connected to a lower area of the tub 30. The drainage mechanism may include a drainage pump 71 configured to provide a drive force for draining the wash water held in the tub 30; and a first drainage pipe 73 configured to guide the wash water held in the tub 30 to the drainage pump 71 and having one end connected to the drainage pump 71 and the other end connected to a rear surface of the cabinet 10. The first drainage pipe 73 may be configured as a bellows pipe to avoid transmitting the vibration of the tub 30 to the drainage pump 71.

A water level sensing unit is provided in a space formed between the cabinet 10 and the tub 30. The water level sensing unit includes an air chamber 81 connected with a lateral surface of the first drainage pipe 73 provided as bellows pipe and configured to fill a preset amount of air therein; a water level sensing tube 83 connected to the air chamber 81 and having the air filled therein to transmit a pressure; and a pressure sensor configured to sense a water level of the wash water based on the pressure transmitted by the air filled in the water level sensing tube 83. When a water pressure at the connecting area with the air chamber 81 rises with a rising water level in the tub 30, the pressure sensor 85 senses the raised pressure via the air chamber 81 and thereby the water level.

As mentioned above, the water level sensing unit includes the pressure sensor 85, but the embodiments of the present disclosure are not limited thereto. As one alternative example, a mechanism for measuring the amount of the wash water may be a flowmeter, sensing flow rather than water pressure.

The front surface 33 of the tub 30 is spaced a preset distance apart from the front surface of the cabinet 10. Accordingly, wash water is likely to permeate between the door 11 and the front tub opening of the tub 30, thereby permeating between the front surface of the cabinet 10 and the front tub opening. To prevent such wash water permeation, a gasket 15 is provided between the front surface of the cabinet 10 and the front tub opening. The tub 30 is likely to be vibrated by the vibration of the motor 50. The gasket 15 is made of a flexible material that does not transmit such vibration of the tub 30 to the cabinet 10 there through.

The gasket 15 has a door area 151 and a tub area 152. The tub area shown in FIG. 1 is formed concave, but the embodiments are not limited thereto. When the gasket 152 is used for a long period of time, detergent residues, contaminants or water furs (scale or slime) are likely to accumulate.

The drum 40 is rotatably mounted in the tub 30 to have the laundry loaded therein. The drum is formed in an approximately cylindrical shape and divided into a circumferential surface and both ends, like the tub 30. A front one of the ends forms a front surface 43 of the drum and the other rear one forms a rear surface 45 of the drum.

The rear surface 45 of the drum 40 is directly connected with the shaft 55 connected with the motor 50 so as to be provided with the rotational force by the motor 50. A lifter 49 is provided in the inner circumferential surface of the drum to lift and drop a predetermined amount of the laundry or wash water loaded in the drum 40, while the drum 40 is rotated by the motor 50. Accordingly, once the drum 40 is rotated by the motor 50, the lifter 49 is rotated together with the drum 40 and lifts and drops the predetermined amount of the laundry toward the inner circumferential surface.

A plurality of through-holes 47 may be formed in a lateral wall, which may be a circumferential surface of the drum 40. The drum 40 can communicate with the tub 30 via the plurality of through-holes 47. When wash water is supplied to the tub 30 and filled to a preset water level or more, the drum 40 becomes submerged in the wash water and a predetermined amount of the wash water is drawn into the drum 40 via the through holes 47.

The controller 17 is configured to control the rotational speed of the motor 50 or the water level of the wash water. The controller 17 may be provided in an upper area of the front surface of the cabinet 10, for example, but the embodiments are not limited thereto.

The controller 17 controls the motor 50 to rotate the drum 40 at a preset rotational speed (or torque). The wash water is circulated along the inner circumferential surface of the tub 30 by the frictional force between the water and the rotating drum 40 such that the water drops from top areas of the opposite ends of the tub, including the tops of the front and rear surfaces 33 and 35 of the tub 30. Accordingly, washing is performed for the tub 30 and the front and rear surfaces 43 and 45 of the drum 40.

The circulation of the wash water will be described in detail, referring to FIG. 2. FIG. 2 is an enlarged view of section 'I' shown in FIG. 1 to describe wash water flow.

Referring to FIG. 2, the wash water has a circulation pattern that includes a first circulation 91 for circulating the wash water along an area spaced apart from the circumferential surface of the tub 30 by using the rotational force of the drum 40; a second circulation 92 for dropping the wash water from the upper areas of the tub ends, in other words, the upper areas of the tub front and rear surfaces 33 and 35 via the area 36 spaced apart from the tub front surface; and a third circulation 93 for lifting the wash water from the lower areas of the tub front and rear surfaces 33 and 35 via the area spaced from the rear surface.

The first circulation 91 shows the circulation pattern in which the wash water is circulated along the inner circumferential surface of the tub 30 and the outer circumferential surface of the drum 40 to wash the surfaces of the tub and the drum. Some of the wash water from the first circulation 91 is added to the second circulation 92 to fall from the upper areas of the tub front and rear surfaces 33 and 35.

The second circulation 92 shows the circulation pattern for lifting the wash water to the top of the tub front surface 33 or rear surface and then dropping the wash water. The second circulation 92 is configured to wash the door inner surface 14, the front and rear surfaces of the tub 30 and drum 40 and the gasket 15.

The third circulation 93 shows the circulation pattern in which the wash water is in close contact with the inner circumferential surface of the tub 30 as a result of the centrifugal force generated by the rotating wash water and then pushed to the ends of the tub 30. The third circulation 93 is configured to wash the gasket 15 and the lower area of the door inner surface 14.

At least a predetermined area of the drum outer circumferential surface preferably comes into contact with the wash water such that the rotational force of the drum 40 causes the wash water to circulate or rotate along the tub inner circumferential surface. Accordingly, the controller 17 is configured to supply the wash water to the tub 30 until the water level reaches a preset water level.

The water level of the wash water will be described, referring to FIG. 3. FIG. 3 is an enlarged view of section 'II' shown in FIG. 2 to describe a water level of wash water.

Referring to FIG. 3, the controller 17 controls the preset wash water level 95 to be the minimum water level 97 or more which is at least the height from the lower end of the tub 30 to the lower end of the drum 40. At least predetermined area of the drum preferably comes into contact with the wash water so as circulate the wash water via the friction with the drum 40.

Meanwhile, the controller 17 may control the preset water level to become higher such that the user can directly check the circulation of the wash water performed by the washing operation through the door 11. In particular, the controller 17 may control the preset water level such that the user viewing the inside of the drum 40 through the door 11 is able to visually check whether the tub is being washed currently.

The preset water level has no maximum limit. However, the controller 17 typically controls the preset water level to become smaller than the full or highest water level 96. In this instance, the full water level 96 means the water level at which the tub 30 and the drum 40 are filled with the wash water to overflow to the gasket 15.

At the full water level 96, the wash water has the risk of flowing toward the door 11 enough to leak and the frictional force between the drum 40 and the wash water is likely to become stronger such that the force is enough to cause noise and vibration, potentially causing an overload on the motor 50.

The preset water level of the wash water is applicable even to the tilting type drum washing machine 1 having the shaft 55 tilted at a preset angle with respect to the ground, unlike the drum washing machine 1 having the shaft 55 horizontally oriented with respect to the ground shown in FIGS. 1 through 3. In this instance, the front area of the drum 40 is located higher than the rear area with respect to the ground, and the water level at which the front area of the drum is submerged in the wash water may be different from the water level at which the rear area of the tub is submerged in the wash water.

An input unit 19 may be additionally provided in the area where the controller 17 is provided and the input unit 19 may be configured to receive the user's input configured to start the washing operation configured to wash the inner circumferential surface of the tub 30.

More specifically, a rotary knob or buttons may be provided in the control panel of the conventional drum washing machine 1 to receive the user's input of the drum washing machine operation. Accordingly, the input unit 19 configured to wash the tub 30 or an auxiliary button may be provided in the rotary knob. The tub 30 may be washed, when a conventional operation mode is input. The washing operation for washing the inner circumferential surface of the tub 30 may be enabled by default or option.

Hereinafter, a method for washing the tub of the drum washing machine 1 in accordance with one embodiment will be described.

The tub washing method is included in a control method of the drum washing machine 1. The control method of the drum washing machine 1 may include a wash cycle, a rinse cycle and a dry-spin cycle.

The tub washing method includes a course recognizing step, a braking step (E) and a tub washing step in accordance with diverse embodiments. The tub washing method may further include one or more of a first spinning step (S200), a second spinning step (S500) and a third spinning step (S700). In other words, the tub washing operation, which includes the operation for washing the door inner surface 14 and the gasket 15 as well as the tub 20 and the drum 40 may be independently performed according to the user's selection recognized in the course recognizing step without the operation of the other cycles. The method may facilitate the most efficient control of the wash water level and the rotation of the drum 40, associated with at least one of the first through third spinning steps (S200, S500 and S700).

The first through third spinning steps (S200, S500 and S700) are not included in only one of the wash, rinse and dry-spin cycles. They may be included in any cycles to efficiently perform the braking step (E) and the tub washing step in accordance with diverse embodiments. As one example, the first spinning step (S200) may correspond to a wash-spinning step of the wash cycle or a rinse-spinning step of the rinse cycle. The second spinning step (S500) may correspond to a rinse-spinning of the rinse cycle or a pre-spinning or intermediate-spinning of the dry-spin cycle. The third spinning step (S700) may correspond to a main-spinning of the dry-spin cycle, but the embodiments are not limited thereto.

The tub washing method of the drum washing machine 1 in accordance with one embodiment will be described in detail, referring to FIG. 4. FIG. 4 is a graph illustrating a tub washing method in accordance with one embodiment.

Referring to FIG. 4, the tub washing method of the drum washing machine 1 in accordance with the embodiment includes a first spinning step (S200), a braking step (E) and a tub washing step (A).

The first spinning step (S200) is provided to remove water or moisture from the laundry loaded in the drum 40. The first spinning step includes a spin RPM maintaining step (210) configured to rotate the drum 40, while maintaining the highest RPM in the first spinning step (S200), in other words, a spinning RPM (RPM D1). The first spinning step (S200) is performed in a state where the drainage pump 71 is switched on to exhaust the wash water containing contaminants of the laundry and detergent in the tub 30. As the first spinning step (S200) is performed, the laundry loaded in the drum 40 is relieved of the wash water containing the detergent and contaminants in a state of closely contacting with the inner circumferential surface of the drum 40 and also an amount of detergent and contaminants in the tub 30. Accordingly, the tub washing step (A) performed after the first spinning step (S200) starts washing in a state where the wash water supplied to the tub 30 is relatively less contaminated by remaining detergent and contaminants.

The braking step (E) may be performed after the first spinning step (S200) and apply a braking force to the drum 40 to lower the rotation speed to a first RPM from the spinning RPM (RPM D1). In other words, the drum 40 is not stopped even when the braking step (E) is performed but is rotated at the first RPM lowered from the spinning RPM (RPM D1).

The tub washing step (A) is performed after the braking step (E) and includes a first rotating step (A1), a second rotating step (A2) and a braking step (A3).

The first rotating step (A1) is configured to include supplying wash water to the tub 30 from the external water supply source and rotating the drum 40 at the first RPM or higher. At this time, the drainage pump 71 is controlled to keep an OFF-state. The OFF-state is maintained until a preset stage of the rinsing step. Accordingly, the wash water supplied in the first rotating step (A1) may not be discharged from the tub 30 continuously through the next second rotating step (A2) but the wash water may be used as rinse water in the rinsing step, without the need for additional water supply.

The first rotating step (A1) starts the rotation of the drum 40 at the first RPM after the braking step (E) applies the braking force to the drum 40 to slow the rotation of the drum down to the first RPM at the end of the first spinning step (S200). Accordingly, the drum 40 is not stopped from the braking step (E) to the end of the first rotating step (A1).

The first RPM may be defined as the minimum RPM to prevent the laundry rotated along the rotating drum 40 from falling from the inner circumferential surface of the drum 40 where the laundry is maintained by the centrifugal force. In other words, the first RPM may be the RPM at which the rotation of the drum is able to generate a centrifugal force of 1 G or more. The first RPM as the rotational speed configured to closely contact the laundry with the inner circumferential surface of the drum 40 may be approximately 60~80 rpm. During the second rotating step (A2) performed after the first rotating step, the first RPM may be increased to 108 rpm.

Meanwhile, if the first RPM is too high, there could be an error in the pressor sensor 85 configured to measure the water level. If the drum 40 is rotated at a high rotation speed, the water level of the wash water located in one side of the drum 40 rises and that of the wash water located in the other side falls. When the first drainage pipe 73 is connected with the one side, the water pressure applied to the first drainage pipe 73 may rise together with the rise of the water level. At this time, some force is applied to the air chamber 81 connected with the lateral surface of the first drainage pipe 73 such that the pressure sensor could sense that the water level is higher than the actual water level. Accordingly, the first RPM needs to be set as the RPM at which the rotation of the drum generates the rise of the water level in a preset range so as to prevent the water level error of the pressure sensor 85.

Each piece of the laundry loaded in the drum 40 has a different water content based on the type of fabric. When the first spinning step (S200) is performed to dry the moisture contained in the laundry, the distribution of the moisture contained in the laundry loaded in the drum 40 is changed enough to change the eccentricity of the drum 40. In addition, the laundry may not move in close contact with the inner circumferential surface of the drum 40 during the operation of the first rotating step (A1) and the distribution of the moisture contained in the laundry loaded in the drum may be partially changed by the wash water supply.

A changed amount of the eccentricity may be sensed in the second rotating step (A2) as well as the first rotating step (A1) before the second rotating step (A2) for rotating the drum at a second RPM higher than the first RPM is performed.

At this time, the eccentricity of the drum means the phenomenon that one side with respect to the center of the drum becomes heavier as a result of the laundry shifting more to the one side when the laundry is entangled in the rotating drum. The amount of the eccentricity may be characterized by digitizing the levels of eccentricity. When the drum is rotated at a high speed with an eccentric load of laundry, for example, drum unbalance could generate noise and vibration. The drum unbalance means that the geometric center of the axis of the drum does not match the actual center of the gravity.

When the sensed eccentricity value is a reference value or less, the second rotating step (A2) starts. When the sensed eccentricity is over the reference value, the drainage pump 71 is switched ON from OFF and the wash water remaining in the tub 30 starts to be drained. Hence, the first rotating step (A1) re-starts and the eccentricity value is sensed. Such operation is repeatedly performed until the sensed eccentricity value is the reference value or less. If the operation is repeated too many times, energy waste such as electricity loss might be caused. The controller 17 may be configured to end the steps when the operation is repeated more than a preset number of times. If the sensed eccentricity value is over the reference value, the rinsing step (S300) may start right away with the wash water remaining in the tub, which has not been drained, as one alternative example. The drainage pump maintains the OFF-state in this alternative example so as to not drain the wash water.

The first rotating step (A1) is configured to include supplying wash water to the tub 30 until the water reaches a preset water level. As mentioned above, the first rotating step (A1) supplies wash water until the preset wash water level reaches the minimum water level 97 or more, which is the height from the lower end of the tub 30 to the lower end of the drum 40. In particular, the first rotating step (A1) may supply the wash water to a level such that the user viewing the inside of the drum through the door 11 is able to visually check that the tub washing is performed. At this time, it is preferred that the preset water level is the full water level, in other words, the water level of the wash water filled in the tub 30 and the drum 40 and overflowing to the gasket 15.

The second rotating step (A2) is performed after the first rotating step (A1) is completed. The rotation speed of the drum 40 is accelerated from the first RPM to the second RPM in the second rotating step (A2). The wash water is not supplied to the tub 30 and the drainage pump 71 maintains the OFF-state in the second rotating step.

While the drum 40 is rotated in the second rotating step (A2), the wash water supplied to the tub to the preset water level or more may be circulated along the circulation pattern configured of the first through third circulations 91, 92 and 93 discussed above. The wash water circulated along the circulation pattern may be defined as circulating water. The circulating water having the circulation pattern may wash the inner circumferential surface of the tub 30 and the outer circumferential surface of the drum 40, the gasket 15 and the inner surface of the door 14.

Once the second rotating step (A2) is complete, the braking step (A3) starts. Rotation of the drum 40 may be slowed down until the drum is stopped.

Hence, the rinsing step (S300) starts and the water level is measured in the rinsing step (S300). When the measured water level is a preset rinsing water level or less, additional water supply for additionally supplying wash water into the tub may start. However, when the measured water level is over the preset rinsing water level, the rinsing step (S300) is performed without the additional water supply. In this instance, the water level measuring for the additional water supply is performed after the rotation of the drum is stopped or while the drum is rotated at the minimum RPM which can generate the error of the pressure sensor 85.

Meanwhile, the additional water supply is performed to supply wash water in addition to the amount of the wash water supplied in the first rotating step (A1). When the wash water is supplied in the first rotating step (A1), wash water is additionally supplied during the second rotating step A2 with the exception of the amount of the wash water that will be supplied in the following rinsing step (S300). Accordingly, water is conserved during the tub washing step (A).

The second spinning step (S500) starts once the rinsing step (S300) is complete. The second spinning step (S500) includes a laundry disentangling step (S510); a RPM maintaining step (S530) and an accelerating step (S550).

The laundry disentangling step (S510) accelerates the drum 40 until the drum 40 is rotated by a centrifugal force of 1 G. In the laundry disentangling step (S510), the laundry is circulated in a state of being spaced apart from the inner circumferential surface of the drum 40 during the rotation of the drum 40 such that the laundry can be dispersed and rearranged in the drum 40.

The RPM maintaining step (S530) is configured to rotate the drum at a constant RPM. In the RPM maintaining step (S530), the laundry loaded in drum 40 may be rotated to have approximately a centrifugal force of 1 G. Although not shown in the drawings, ball balancing may be formed.

Meanwhile, the accelerating step (S550) may accelerate the drum 40 to a second spinning RPM and then remove moisture from the laundry.

The third spinning step (S700) starts once the second spinning step (S500) is complete. Similar to the second spinning step (S500), the third spinning step (S700) includes a RPM maintaining step (S710) and an accelerating step (S730).

Meanwhile, the tub washing method of the drum washing machine 1 in accordance with the embodiment may further include a course recognizing step for recognizing at least one course selected from a plurality of washing courses including a tub washing course. The course recognizing step may allow the user to select diverse washing courses so as to perform a desired washing.

The user is able to select a desired tub washing course, in other words, the tub washing step (A) to be performed by default or option via the input unit 19 provided in the area where the controller 17 is provided.

Unless the user selects the tub washing course independently, the tub washing step (A) may be performed by default as mentioned above.

Once the user selects the tub washing course via the input unit 19, in other words, selects to operate the tub washing step (A) by default, the course recognizing step recognizes that the tub washing step is selected and the first and second rotating steps (A1 and A2) of the tub washing step (A) are controlled to start right before the last rinsing step (S300) of the rinsing steps (S300) as one example. The user's selecting of the tub washing step (A) by option means that the user expects a high effect gained by the operation of the tub washing step (A). It is preferred that the tub washing step (A) is performed after contaminants are removed from the tub inside by performing at least one of the rinsing steps (S300).

As one alternative example, when the tub washing step (A) is performed by option, the tub washing step (A) is performed independently, without performing any other cycles. More specifically, only the tub washing step (A) may be performed without the washing course configured of the wash cycle, the rinse cycle and the dry-spin cycle.

A tub washing method of the drum washing machine 1 in accordance with another embodiment will be described in detail, referring to FIG. 5. FIG. 5 is a graph illustrating a tub washing method in accordance with another embodiment. Repeated description of the tub washing method in accordance with this embodiment, compared with the above-noted tub washing method, is omitted.

Referring to FIG. 5, the tub washing method of the drum washing machine 1 in accordance with this embodiment includes a tub washing step (B) having a first water supply step (B1) for supplying water while maintaining an OFF-state of the drainage pump 71, a first washing step (B2), a first braking step (B3), a second water supply step (B4), a second washing step (B5) and a second braking step (B6).

To maximize the washing capacity for the tub, it is preferred that the tub 30 is washed by using the faster water current that is enabled and generated when the drum 40 is rotated at a high rotation speed. However, if the drum 40 is rotated at a high speed after supplying a lot of water to the drum, the torque of the motor 50 might be insufficient, and foams or countercurrent might occur. Accordingly, a following method is invented. According to the method, a relatively small amount of wash water is supplied and the drum 40 is then rotated at a high speed to circulate the wash water along the inner circumferential surface of the tub 30 at a fast rate of circulation. After that, wash water is re-supplied and the drum 40 is rotated at a relatively low speed to circulate the larger amount of the wash water along the inner circumferential surface of the tub 30 at a relatively low speed. In this instance, the wash water rotated at the relatively low speed is cleaner than the wash water rotated at the high speed, because it has the additional water supply.

The contaminants accumulating in the tub 30 may be separated by the wash water that is circulated fast. Hence, the larger amount of the water circulated at the relatively low speed is cleaner and may dissolve the separated contaminants to lower a contamination density of the wash water. The wash water having the lowered contamination density may not allow the separated contaminants to be attached to the tub 30 again, only to maximize the washing capacity.

To achieve the effect, the tub washing method of the drum washing machine 1 performs two divided water supply steps and two divided washing steps.

More specifically, the first water supply step (B1) may supply a small amount of wash water to a preset water level and rotate the drum 40 at a water supply RPM which is the first RPM.

The first washing step (B2) starts once the first water supply step (B1) is complete. In the first washing step (B2), the drum 40 is rotated at a first washing RPM which is a third RPM higher than the second RPM mentioned above. For example, the third RPM is 300 rpm, but the embodiment is not limited thereto. The third RPM may be set as diverse RPMs according to surrounding conditions. The first washing step (B2) rotates the small amount of the wash water at the high speed such that a strong shock may be applied to the area of the tub 30 having the accumulating contaminants when the wash water is collided to the area. Accordingly, a relatively large amount of contaminants can be separated from the tub 30 in the first washing step (B2).

Hence, the accelerating step for accelerating the rotation speed of the drum 40 from the first washing RPM to the water supply RPM may start. In the accelerating step, the drum 40 may not be stopped such that the accelerating step may be performed more quickly. The accelerating step may not need to re-rotate the drum 40 from the stopped state such that energy such as electricity can be saved.

The second water supply step (B4) may supply wash water to a preset water level and rotate the drum 40 at the water supply RPM which is the first RPM. The rotation speed of the drum 40 in the second water supply (B4) is equal to that of the drum 40 in the first water supply step (B1). The preset water level of the second water supply step (B4) may be set to be equal to the preset water level mentioned in the above-noted embodiment. Accordingly, the preset water level of the first water supply step (B1) is lower than the preset water level of the above-noted embodiment.

The second washing step (B5) may start once the second water supply step (B4) is complete. The drum 40 is rotated at a second washing RPM which is the second RPM in the second washing step (B5). The wash water in the second washing step (B5) may contain more contaminants than the wash water in the second rotating step (A2) in the above-noted embodiment.

A tub washing method of the drum washing machine 1 in accordance with a further embodiment will be described in detail. The tub washing method of the drum washing machine 1 will be described, referring FIGS. 4 and 5 again.

Referring to FIGS. 4 and 5, a tub washing step including a first spinning step (S200) and a braking step (E) is shown. In this embodiment, the first spinning step (S200) is referred to as the spinning step (S200) and the first spinning RPM (RPM D1) is referred to as a spinning RPM (RPM D1).

In the tub washing method, wash water is collided with the drum 40 rotated at the spinning RPM (RPM D1), which is much higher than the first RPM and the second RPM mentioned above. In other words, the wash water collided with the drum 40 rotated at the high speed is dispersed fast to strike the inner circumferential surface of the tub 30 such that the contaminants accumulating on the inner circumferential surface of the tub 30 can be separated. In this step, the wash water forms no circulating currents.

For example, the spinning step (S200) rotates the drum 40 at a high speed and the braking step (E) then applies a braking force to the rotating drum. In this instance, when wash water is supplied, the collision between the wash water and the drum 40 may lower the rotation speed of the drum 40 easily so as to save the energy used in lowering the rotation speed of the drum 40.

In other words, the tub washing method in accordance with this embodiment may wash the tub 30 and the like and apply a brake to the rotating drum at the same time by using the kinetic energy of the drum 40 rotated at the high spinning RPM (RPM D1).

To achieve that, the tub washing method in accordance with this embodiment includes a spinning step (S200) for rotating the drum 40 at the spinning RPM (RPM D1); a braking step (E) for applying a brake to the drum 40; a washing water supply step (A1); and a washing step (A2).

The spinning step (S200) rotates the drum 40 at the high spinning RPM (RPM D1) and removes moisture from the laundry held in the drum 40. In the spinning step (S200), the brake may be applied to the drum at the moment when the rotation speed of the drum 40 reaches the spinning RPM (RPM D1). Alternatively, the spinning step (S200) may include a spinning RPM maintaining step (S210) for maintaining the spinning RPM (RPM D1) of the drum 40. The spinning step (S200) ends together with the spinning RPM maintaining step (S210).

The braking step (E) applies a braking force to the drum 40 by colliding wash water with the drum 40 rotated at the high spinning RPM (RPM D1). At this time, it is not limited that the start point of the braking step (E) is after the spinning step (S200) is complete, which will be described later.

Meanwhile, the braking step (E) has a section in which the drum 40 rotated at the spinning RPM (RPM D1) is braked by applying a braking force to drastically lower the spinning RPM to the water supply RPM which is the first RPM. At this time, it necessary to reduce the rotational force of the drum 40 with a strong power so as to drastically lower the rotation speed of the drum 40 such that a fairly large amount of energy may be required. When wash water is supplied to the tub 30, the wash water is collided with the drum 40 rotated at a high speed and the rotation speed of the drum is then lowered such that energy can be saved.

As the wash water is collided with the drum 40, the drum 40 rotated at the high speed may be decelerated. When the motor 50 provides the drum 40 with the rotational force continuously as necessary, the drum 40 may not be decelerated sufficiently.

Meanwhile, the braking step (E) applies a brake to the drum by the collision with the wash water and disperses the wash water collided with the drum 40 toward the inner circumferential surface of the tub 30 at a fast rate to wash the inner circumferential surface of the tub 30 by striking the wash water against the inner circumferential surface. At this time, the speed of the wash water striking the inner circumferential surface of the tub 30 is the highest when the drum 40 is rotated at the spinning RPM (RPM D1) and becomes lower as the drum 40 is decelerated down to the first RPM.

In this instance, the braking step (E) supplies the wash water to different points of the tub by using a plurality of water supply means to strike different points of the inner circumferential surface of the tub 30 and the outer circumferential surface of the drum 40. For example, the braking step (E) may supply the wash water via the first drainage pipe 73 and the second drainage pipe 75 which are spaced a preset distance apart from each other along a longitudinal direction of the tub as shown in FIG. 1. The wash water supplied via the first drainage pipe 73 may strike and wash the front area of the tub 30 after being collided with the front area of the drum 40. The wash water supplied via the second drainage pipe 75 may strike and wash the rear area of the tub 30 after being collided with the rear area of the drum 40.

The positions of the first and second drainage pipes 73 and 75 are not limited to what is mentioned above and they may be adjusted for the wash water to strike the area in which contaminants intensively accumulate in the inner circumferential surface of the tub 30 and the outer circumferential surface of the drum 40.

Meanwhile, when the contaminants accumulate for a long time period, in other words, the power-off period lasts for a long time period, the accumulating contaminants are likely to harden in a state of being stuck on the inner circumferential surface of the tub or the outer circumferential surface of the drum 40. When the controller 17 determines that the power-off period of the drum washing machine 1 is longer than a reference value, the braking step (E) may be controlled to start during the spinning RPM maintaining step (S210) of the spinning step (S200). During the spinning RPM maintaining step (S210), the drum 40 is provided with an additional rotation force by the motor 50 and rotated while maintaining the spinning RPM (RPM D1).

More specifically, when the power-off period of the drum washing machine 1 becomes long, the braking step (E) is controlled to operate during the spinning RPM maintaining step (S210). The highest speed at which the wash water is collided with the drum 40 and thereby strikes the inner circumferential surface of the tub 30 is maintained for a preset time period to sufficiently remove the contaminants accumulating in the tub 30. The braking step (E) may adjust the overlapped duration time braking step (E) with the spinning RPM maintaining step (S210).

Meanwhile, in the spinning step (S200), the drainage pump 71 maintains the ON-state. In the braking step (E), the drainage pump 71 maintains the OFF-state. When the braking step (E) starts during the spinning RPM maintaining step (S210), the drainage pump 71 maintains the OFF state in the overlapped section with the spinning RPM maintaining step (S210). Accordingly, the wash water supplied in the braking step (E) remains in the tub 30 until the rinsing step (S300) is performed through the wash water supply step (A1) and the washing step (A2).

The wash water supply step (A1) is equal to the first rotating step (A1), except a different feature which will be described later. The different feature is that the water level of the wash water is able to reach the preset water level even though supplying an additional amount of the wash water in addition to the amount of the wash water remaining in the tub 30 in the wash water supply step (A1) as the wash water supplied in the braking step (E) remains in the tub 30. The washing step (A2) is equal to the second rotating step (A2).

The tub washing method in accordance with this embodiment which includes the spinning step (S200) and the braking step (E) may include an additional wash water supply step which may be performed after the washing step (A2); and an additional washing step. In this instance, the additional wash water supply step and the additional washing step are equal to the second water supply step B4) and the second washing step (B5), respectively, and the detailed description thereof is omitted.

A tub washing method of the drum washing machine 1 in accordance with a further embodiment will be described in detail. The tub washing method of the drum washing machine 1 will be described, referring FIGS. 6 and 7. FIGS. 6 and 7 illustrate a graph showing a tub washing method in accordance with a further embodiment.

Referring to FIG. 6, the tub washing method of the drum washing machine 1 in accordance with the embodiment includes a tub washing step (C and D) configured of a first rotating step (C1 and D1); a second rotating step ((C2 and D2) and a wash water drainage step (C3 and D3). Together with that, one step (S551) for maintaining the second spinning RPM (RPM D2) and the braking step (E') may be performed before the first rotating step (C1). The second spinning RPM maintaining step (S551) for maintaining a second spinning RPM may be performed with the same principle with the above-noted spinning RPM maintaining step (S210) and the braking step (E') may be performed with the same principle with the above-noted braking step (E), and detailed description thereof is omitted accordingly, In the first rotating step (C1 and D1), a reference eccentricity value used in sensing the eccentricity value of the drum 40 may be different according to the step performed after the wash water draining step. The step performed right before the first rotating step (C1 and D1) may not be the spinning step. This embodiment is distinguished from the above-noted embodiments, which will be described in detail later.

The second rotating step (C2 and D2) includes the wash water draining step (C3 and D3), which is distinguished from the above-noted embodiments. The wash water draining step (C3 and D3) discharges the wash water supplied in the first rotating step (C1 and D1) while the drainage pump 71 is maintaining the ON-state. The wash water draining step (C3 and D3) starts during the second rotating step (C2 and D2) and ends together with the second rotating step (C2 and D2). The embodiments are not limited thereto and the wash water draining step may be overlapped with the next step, which will be described in detail later.

The tub washing method in accordance with this embodiment may include the third spinning step (S700) which starts once the wash water draining step (C3) is complete as one example. The third spinning step (S700) rotates the drum 40 at a very high speed and it may be corresponding to the main-spinning of the dry-spin cycle which rotates the drum 40 at the highest speed but is not limited thereto.

In this instance, the third spinning step (S700) may have no auxiliary eccentricity value sensing or ball balancing step. Only in the first rotating step (C1), the eccentricity value of the drum 40 may be sensed. At this time, the sensed eccentricity value is a reference eccentricity value or less which can allow the performance of the third spinning step (S700) for rotating the drum at a much higher RPM than the second RPM of the second rotating step (C2) through the second rotating step (C2). Accordingly, the reference eccentricity value of this embodiment is much smaller than a reference eccentricity value which can allow the performance of the second rotating step (C2) mentioned above. However, that is only one example, not excluding that the eccentricity value is sensed in the second rotating step (C2). The operation performed in case the eccentricity values measured in the first rotating step (C1) and the second rotating step (C2), respectively, are over the reference eccentricity value may be equal to the operation performed in case the eccentricity values measured in the first rotating step (A1) and the second rotating step (A2), respectively, are the reference eccentricity value or more, except that the dry-spin cycle is performed.

The wash water draining step (C3) may end together with the second rotating step (C2) to drain the wash water already used before the third spinning step (S700) starts as mentioned above. However, not limited thereto, the wash water draining step (C3) may end before the second rotating step (C2).

As another example of the tub washing method in accordance with this embodiment, the second spinning step (S500) and the third spinning step (S700) may be performed sequentially after the wash water draining step (D3) ends. The second spinning step (S500) rotates the drum 40 at a lower RPM than the highest RPM of the third spinning step (S700). The second spinning step (S500) may correspond to an intermediate spinning of the rinse cycle or a pre-spinning step of the dry-spin cycle, not limited thereto.

The first rotating step (D1) senses the eccentricity value of the drum 400. When the sensed eccentricity value is a reference eccentricity value or less, the second rotating step (D2) starts. At this time, the reference eccentricity value may be set only to perform the second rotating step (D2). In this instance, to perform the second spinning step (S500) for rotating the drum at the second spinning RPM (RPM D2) higher than the second RPM, the wash water draining step (D3) may adjust the wash water held in the tub 30 and improve the characteristics of the vibration generated during the second spinning step (S500).

However, the embodiments are not limited thereto, and the reference eccentricity value may be set to perform the second spinning step (S500) through the second rotating step (D2). At this time, the reference eccentricity value may be set smaller than the reference eccentricity value set to perform the second rotating step (D2).

The second rotating step (D2) may start once the first rotating step (D1) is complete and maintain the OFF-state of the drainage pump 71.

Meanwhile, the eccentricity value may be sensed only in the first rotating step (D1) but is not limited thereto. The eccentricity may be sensed even in the second rotating step (C2). The operation performed in case the eccentricity values sensed in the first rotating step (D1) and the second rotating step (D2), respectively, are over the reference eccentricity value may be the same with the operation performed in case the eccentricity values are the reference eccentricity value or more, except that the spinning step (S700) is performed.

The wash water draining step (D3) may start while the second rotating step (D2) is being operated and maintain the ON-state of the drainage pump 71. When the reference eccentricity value of the first rotating step (D1) is set to perform the second rotating step (D2), the drum might vibrate during the second spinning step (S500) for rotating the drum at the second spinning RPM (RPM D2) higher than the second RPM. Especially, in a section of the second spinning step in which the drum is accelerated to the second spinning RPM (RPM D2), the vibration of the drum matches the natural frequency of the drum washing machine and a normal vibration frequency mode may be generated in which the vibration of the washing machine increases toward infinity. In this instance, the drum 40 is employed as vibration generating source and the tub 30 as vibration transmitting media to receive and transmit the vibration of the drum 40 to the cabinet 10. Accordingly, the drum washing machine 1 is likely to vibrate severely and severe noise could be generated during the washing process.

In this instance, when wash water remains in the tub transmitting the vibration of the drum 40 to the cabinet 10, the vibration transmitting media is changed from the tub 30 to both the tub and the wash water such that the weight of the vibration transmitting media may be increased. Accordingly, the vibration transmitting media is vibrating, while the amount of vibration is decreased, and the noise generated by the vibration may be solved.

More specifically, the amount of the drained wash water during the wash water draining step (D3) may be adjusted to lower the wash water level in the tub 30 to the lower end of the drum or lower, while a preset amount of the wash water is controlled to remain in the tub 30. During the second spinning step (S500), especially, the accelerating step of the second spinning step (S500), the tub 30 maintains the wash water holding state so as to improve the vibration characteristic. The amount of the wash water remaining in the tub 30 may be adjusted to relieve the normal vibration frequency mode in the second spinning step (S500) as much as possible.

An end point of the wash water draining step (D3) may be adjusted together with the amount of the drained wash water. In other words, the wash water draining step (D3) may be controlled such that no wash water remains in the tub at the end point. The wash water draining step (D3) may end at the same time when the second spinning step (S500) ends, so as for the wash water to remain in the tub 30 during the accelerating step of the second spinning step (S500). Only when the noise generated by the vibration can be solved in a specific section having the severe vibration of the drum 40, the end point of the wash water draining step (D3) may be set as various points but is not limited thereto.

The third spinning step (S700) may start after the second spinning step (S500) and include a ball balancing step and an accelerating step. Accordingly, the reference eccentricity value in the first rotating step (D1) is not necessarily set to perform the third spinning step (S700).

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A method of controlling a washing machine, wherein the washing machine comprises a tub and a drum rotatably supported in the tub, the method comprising:

performing a spinning step to remove moisture from laundry loaded in the drum, the spinning step including accelerating the drum to a spinning RPM; and performing a tub washing method for washing the tub after the spinning step, the tub washing method comprising:

performing a first rotating step supplying wash water to the tub up to a preset water level while the drum is rotated at a first RPM lower than the spinning RPM; and performing a second rotating step after the first rotating step, the second rotating step comprising accelerating the rotating drum from the first RPM to a second RPM higher than the first RPM to cause the wash water to form a circulating water current falling from an upper area of opposite ends of the tub in a first washing step while being circulated along an inner circumferential surface of the tub by a rotational force of the drum.

2. The method of claim 1, further comprising:

accelerating the drum to perform the spinning step during a wash cycle of the washing machine for removing moisture from laundry loaded in the drum, wherein the first rotating step supplying wash water to the tub includes continuously rotating the drum as the drum is decelerated to the first RPM when the spinning step ends.

3. The method of claim 1, wherein the first RPM is a minimum RPM to generate a centrifugal force required to prevent laundry rotated along the rotating drum from becoming separated from an inner circumferential surface of the drum.

4. The method of claim 1, wherein the first rotating step includes the supplying of wash water to the tub until the water level reaches the preset water level, and switching off a drainage pump.

5. The method of claim 1, wherein the preset water level of the first rotating step is a water level at which a user is able to check the supplied wash water from a position outside of the drum.

6. The method of claim 1, wherein the preset water level of the first rotating step is at least at a height from a lower end of the tub to a lower end of the drum.

7. The method of claim 1, wherein a drainage pump is switched off in the second rotating step.

8. The method of claim 1, wherein at least one of the first rotating step or the second rotating step further includes sensing an eccentricity value of the drum.

9. The method of claim 8, wherein the tub washing method further comprises a re-starting of the first rotating step when the sensed eccentricity value is over a reference eccentricity value, the re-starting of the first rotating step re-starts the first rotating step after draining the wash water remaining in the tub.

10. The method of claim 8, further comprising:

performing a rinsing step for rinsing laundry after the tub washing method, wherein the tub washing method ends and the rinsing step starts when the sensed eccentricity value is over a reference eccentricity value in a state where a drainage pump is switched off from the tub washing method to keep the wash water in the tub.

11. The method of claim 1, further comprising:

performing a third rotating step supplying wash water once the first washing step is complete, the third rotating step supplying wash water including allowing additional water supply to the tub while the drum is rotated at the first RPM; and performing a second washing step once the third rotating step supplying wash water is complete, the second washing step including accelerating and rotating the drum at a third RPM higher than the first RPM and lower than the second RPM for the wash water, and increasing an amount of wash water by the additional water supply to form the circulating water current.

12. The method of claim 11, wherein the third rotating step supplying wash water includes continuously rotating the drum after decelerating a rotation of the drum to the first RPM when the first washing step ends.

13. The method of claim 1, further comprising:

performing the spinning step during a wash cycle of the washing machine to remove moisture from laundry loaded in the drum, the spinning step including accelerating the drum to the spinning RPM; and performing a braking step after the spinning step to apply a preset amount of braking force to the rotating drum by colliding the supplied wash water with the rotating drum and supplying the wash water toward an outer circumferential surface of the drum for the wash water collided with the drum to strike and wash at least one point of the inner circumferential surface of the tub.

14. The method of claim 13, wherein the spinning step includes supplying the wash water toward the outer circumferential surface of the rotating drum.

15. The method of claim 14, wherein the spinning step comprises, rotating the drum while maintaining the spinning RPM of the drum, and supplying wash water toward the outer circumferential surface of the rotating drum while maintaining the spinning RPM.

16. The method of claim 13, wherein the braking step includes switching off a drainage pump.

17. The method of claim 13, wherein during the braking step, the wash water is supplied via a plurality of wash water supply units provided to strike the wash water against a plurality of points of the inner circumferential surface of the tub.

18. The method of claim 17, wherein the plurality of wash water supply units are spaced a preset distance apart from each other along a longitudinal direction of the tub.

19. The method of claim 13, wherein the first rotating step supplying wash water to the tub is performed after the braking step and includes continuously rotating the drum at the first RPM after decelerating the drum to the first RPM in the braking step.

20. The method of claim 19, further comprising:

a tub washing course for circulating the wash water along the inner circumferential surface of the tub; and a course recognizing step for recognizing selection by a user of at least one of a plurality of washing courses including the tub washing course, wherein when one of the washing courses is recognized, the first rotating step supplying wash water to the tub and the first washing step start right before a last step of a rinse cycle, and when only the tub washing course is recognized, only the first rotating step supplying wash water to the tub and the first washing step are started without operation of other wash cycles.

* * * * *